US011952860B2

(12) United States Patent
Qin et al.

(10) Patent No.: US 11,952,860 B2
(45) Date of Patent: Apr. 9, 2024

(54) STAGED CEMENTING DEVICE AND STAGED CEMENTING METHOD

(71) Applicants: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

(72) Inventors: Jinli Qin, Beijing (CN); Yang Liu, Beijing (CN); Wujun Chen, Beijing (CN); Ben Liu, Beijing (CN); Zhaohui Guo, Beijing (CN); Yanjun Zeng, Beijing (CN); Ming Liu, Beijing (CN); Dekai Yang, Beijing (CN); Yujie Zhu, Beijing (CN); Hongqian Liao, Beijing (CN)

(73) Assignees: China Petroleum & Chemical Corporation, Beijing (CN); Sinopec Petroleum Engineering Technology Research Institute Co., Ltd., Beijing (CN)

( * ) Notice: Subject to any disclaimer, the term of this patent is extended or adjusted under 35 U.S.C. 154(b) by 0 days.

(21) Appl. No.: 17/995,799

(22) PCT Filed: Feb. 1, 2021

(86) PCT No.: PCT/CN2021/074711
§ 371 (c)(1),
(2) Date: Oct. 7, 2022

(87) PCT Pub. No.: WO2022/001102
PCT Pub. Date: Jan. 6, 2022

(65) Prior Publication Data

US 2023/0142393 A1 May 11, 2023

(30) Foreign Application Priority Data

Jun. 28, 2020 (CN) ..... 202010596606.1

(51) Int. Cl.
*E21B 33/14* (2006.01)
*E21B 33/12* (2006.01)
(Continued)

(52) U.S. Cl.
CPC ..... *E21B 33/146* (2013.01); *E21B 33/126* (2013.01); *E21B 34/14* (2013.01);
(Continued)

(58) Field of Classification Search
CPC .. E21B 33/126; E21B 33/127; E21B 33/1243; E21B 33/1246; E21B 33/1275;
(Continued)

(56) References Cited

U.S. PATENT DOCUMENTS

2004/0031610 A1* 2/2004 Schultz ..... E21B 33/146 166/285
2009/0000782 A1 1/2009 Revheim

FOREIGN PATENT DOCUMENTS

CA 2101492 A1 2/1994
CN 101929318 A 12/2010
(Continued)

OTHER PUBLICATIONS

He, English translation of CN-108590574, original document published Sep. 2018.*

*Primary Examiner* — Tara Schimpf
*Assistant Examiner* — Lamia Quaim
(74) *Attorney, Agent, or Firm* — NKL Law; Allen Xue

(57) ABSTRACT

A staged cementing device includes a cylindrical body having an inner chamber. A circulating opening and a liquid inlet recess open to the inner chamber are arranged on a wall
(Continued)

of the body. An opening assembly is arranged in the body, which has an opening sleeve and an opening seat located in the opening sleeve. Initially the opening sleeve is connected with the body through a first shear pin and covers the circulating opening, and the opening seat is connected with the opening sleeve through a second shear pin and covers the liquid inlet recess. A packer includes a packing valve body and a packer rubber. The packing valve body includes a flow channel in communication with the liquid inlet recess, and the packer rubber includes a liquid reservoir in communication with the flow channel. The second shear pin is sheared off in response to primary cementing procedure.

14 Claims, 6 Drawing Sheets

(51) Int. Cl.

| | |
|---|---|
| ***E21B 33/126*** | (2006.01) |
| ***E21B 34/14*** | (2006.01) |
| *E21B 33/127* | (2006.01) |
| *E21B 33/13* | (2006.01) |

(52) U.S. Cl.
CPC ..... *E21B 33/12* (2013.01); *E21B 33/127* (2013.01); *E21B 33/13* (2013.01)

(58) Field of Classification Search
CPC ..... E21B 33/1277; E21B 33/1285; E21B 33/146; E21B 33/12
See application file for complete search history.

(56) References Cited

FOREIGN PATENT DOCUMENTS

| | | | |
|---|---|---|---|
| CN | 103711453 | A | 4/2014 |
| CN | 104234658 | A | 12/2014 |
| CN | 107975352 | A | 5/2018 |
| CN | 108590574 | A | 9/2018 |
| CN | 208347740 | U | 1/2019 |
| CN | 109869114 | A | 6/2019 |
| CN | 112343540 | A | 2/2021 |
| GB | 2079819 | A | 1/1982 |
| RU | 95108049 | A | 2/1997 |
| RU | 2095544 | C1 | 11/1997 |

* cited by examiner

STAGED CEMENTING DEVICE AND STAGED CEMENTING METHOD

CROSS REFERENCE OF RELATED APPLICATION

This application is a U.S. national stage entry of PCT International Application No. PCT/CN2021/074711, filed on Feb. 1, 2021, which claims the priority of Chinese patent application. No. 202010596606.1, entitled "Staged cementing device" and filed on Jun. 28, 2020, the content of which is incorporated herein by reference in its entirety.

TECHNICAL FIELD

The present invention relates to the technology of petroleum well cementation, in particular, to a staged cementing device, and more specifically, to a staged cementing device with a multiple-expansible packer. The present invention further relates to a staged cementing method using the staged cementing device.

TECHNICAL BACKGROUND

Well cementation technology is an important technical link in the well drilling and completing process. The quality of well cementation directly affects subsequent operations in oil and gas 20 production.

Staged cementing process is a common process in the well cementation technology. As explorations and exploitations continue to deepen, more and more ultra-deep wells have been developed. When the well cementation with an intermediate casing is performed on some wells, due to the poor 25 cementing ability and low loading capacity of the formation, the staged cementing process is often used to reduce the liquid column pressure, and thus reduce leakage. However, for ultra-deep absorption wells, even if the staged cementing process is adopted, leakage will still occur during a primary cementing procedure. Moreover, since the lost layer has not been sealed after the primary cementing procedure, leakage, even loss of return loss, will still exist during a secondary cementing 30 procedure. Accordingly, the quality of well cementation cannot be ensured even with a subsequent cementing extrusion, so that the cost-effectiveness is low and thus it is difficult to satisfy the demand on improving speed and efficiency for oil-field developments. In addition, after the production in some areas, the annulus of the intermediate casing will suffer pressure problem of different degrees. In order to ensure safe production, it is required to inject protective liquid into the annulus. However, the cost is high and the management is difficult.

A staged cementing device with a packer can seal the leakage layer or the reservoir, partially reducing leakage in the well cementation or protecting the reservoir. However, the expandable fluid of the packer is a drilling fluid without strength. After the process is completed, the packer will be always under hydraulic pressure, resulting in the risk of packer aging and liquid leakage. In addition, there are irregularities in the wellbore, which will generate tiny gaps during the expansion of the packer. When there is gas in the well, the gas will pass through the packer to cause the pressure problem in the annulus.

Therefore, it is difficult for the current staged cementing process to meet the requirements of well cementation nowadays.

SUMMARY OF THE PRESENT INVENTION

Directed to the above problems, the present invention proposes a staged cementing device, and a staged cementing method using the staged cementing device.

According to a first aspect of the present invention, a staged cementing device is proposed, comprising: a hollow cylindrical body, which includes an inner chamber, a circulating opening extending through a wall of the body, and a liquid inlet recess open to the inner chamber and formed on the wall of the body; an opening assembly arranged in the body, the opening assembly comprising an opening sleeve and an opening seat located in the opening sleeve, wherein in an initial state, the opening sleeve is connected with the body through a first shear pin and covers the circulating opening, and the opening seat is connected with the opening sleeve through a second shear pin and covers the liquid inlet recess; and a packer, which includes a packing valve body connected with a downstream end of the body, and a packer rubber arranged downstream of the packing valve body, the packing valve body including a flow channel in communication with the liquid inlet recess, and the packer rubber including a liquid reservoir in communication with the flow channel. The second shear pin is configured to be sheared off in response to a primary pressure build-up in the body after completion of a primary cementing procedure, causing the opening seat to move downward to open the liquid inlet recess, whereby swelling fluid entering the inner chamber of the body in the primary cementing procedure enters the liquid reservoir through the liquid inlet recess and the flow channel, thereby causing the packer rubber to expand.

In an embodiment, the liquid reservoir is filled with an accelerant, which is capable of reacting with the swelling fluid so that the packer rubber generates a secondary expansion.

In an embodiment, the swelling liquid is a part of displacing fluid. Preferably, the swelling liquid is liquid epoxy resin, and the accelerant is liquid adjuvant.

In an embodiment, the primary pressure build-up is achieved by putting down an opening tool engageable with the opening seat.

In an embodiment, a receiving seat is further provided at a downstream end of the opening sleeve, for restricting a distance of downstream movement of the opening seat.

In an embodiment, the liquid inlet recess is configured as a groove formed in an inner wall of the body, wherein the flow channel is formed in a wall of the packing valve body, and extends axially throughout the packing valve body.

In an embodiment, the packer further comprises a base pipe fixedly connected with the packing 25 valve body, wherein the base pipe is located radially inside the packer rubber, and the liquid reservoir is formed by a gap between the base pipe and the packer rubber.

In an embodiment, two supporting sleeves separated from each other are provided on an outer surface of the packer rubber, for defining an axial area where the packer rubber expands.

In an embodiment, the first shear pin is capable of being sheared off in response to a secondary pressure build-up in the body, so that the opening sleeve is caused to move downstream, thereby opening the circulating opening and closing the liquid inlet recess.

In an embodiment, a closing sleeve is provided upstream of the opening sleeve, and connected with the body through a third shear pin. The third shear pin is configured to be sheared off in response to a tertiary pressure build-up in the body during a secondary cementing procedure, causing the closing sleeve to move downstream to close the circulating opening.

In an embodiment, a closing seat is provided in the closing sleeve, wherein the tertiary pressure build-up is achieved through putting down a closing tool engageable with the closing seat.

In an embodiment, an elastic member is provided on an outer wall of the closing sleeve, and an elastic-member receiving groove is provided in the inner wall of the body, for accommodating the elastic member and maintaining a position of the closing sleeve after the closing sleeve closes the circulating opening.

In an embodiment, the packer rubber is made of hydrocarbon-expansible rubber.

According to a second aspect of the present invention, a staged cementing method with the staged cementing device as mentioned above is proposed, comprising steps of: putting down an opening tool in the staged cementing device to engage with the opening seat, and shearing off the second shear pin through the primary pressure build-up, so that the opening seat moves downstream to open the said liquid inlet; flowing the swelling liquid to enter the liquid reservoir through the inner chamber of the body, the liquid inlet recess and the flow channel, thereby causing the packer rubber to expand; shearing off the first shear pin through the secondary pressure build-up so that the opening sleeve moves downstream to open the circulating opening, and at the same time communication between the liquid inlet recess and the flow channel is cut off; and putting down the closing tool to be in engagement with the closing seat, and shearing off the third shear pin through the tertiary pressure build-up, so that the closing sleeve moves downstream to close the circulating opening again.

In an embodiment, the swelling fluid is reacted with the accelerant in the liquid reservoir, for the secondary expansion of the packer rubber.

According to the staged cementing device of the present invention, the packer is not affected by the pressure in the pipe. The liquid injection channel cannot be opened without the opening tool, thus avoiding accidental opening operation caused by the pressure in the tube. In addition, after the liquid injection channel is opened, the displacing fluid enters the liquid reservoir of the packer rubber, realizing the primary expansion of the packer to block up the annulus. In this way, after the circulating opening is opened, the liquid column pressure will be reduced due to the primary expansion of the packer which blocks up the annulus, thereby reducing the leakage of the primary cement mud, preventing the leakage of the cement in the secondary cementing procedure, and thus improving the quality of the well cementation. Moreover, the accelerant in the packer will be chemically reacted with the displacing fluid to be cured in a predetermined time, thus forming into one piece with the packer rubber. In this way, after curing, the packer rubber will not shrink but expand slightly in terms of volume, thereby realizing the secondary expansion of the packer.

Therefore, it is possible to avoid the aging and damage of the packer rubber, which may cause the liquid to flow out and eventually lead to the failure of the packer. Further, the packer rubber of the packer is made of hydrocarbon-expansible rubber, which can, on the basis of previous expansions, generate a further expansion (i.e., tertiary expansion) with hydrocarbon medium, such as gas or oil, in the reservoir. This tertiary expansion can fill tiny gaps, thus further improving the long-term sealing ability of the packer.

BRIEF DESCRIPTION OF THE DRAWINGS

In the following the present invention will be explained in more detail by way of illustrative exemplary embodiments with reference to the accompanying drawings. In the drawings.

In the drawings, the same reference numerals are used to indicate the same components. The drawings are not drawn to actual scale.

DETAILED DESCRIPTION OF EMBODIMENTS

The present invention will be further described below with reference to the accompanying drawings. In the context of the present invention, directional terms "down", "downstream", "downward" or the like refer to a direction away from the well head, while directional terms "upper", "upstream", "upward" or the like refer to a direction toward the well head.

Figure 1:
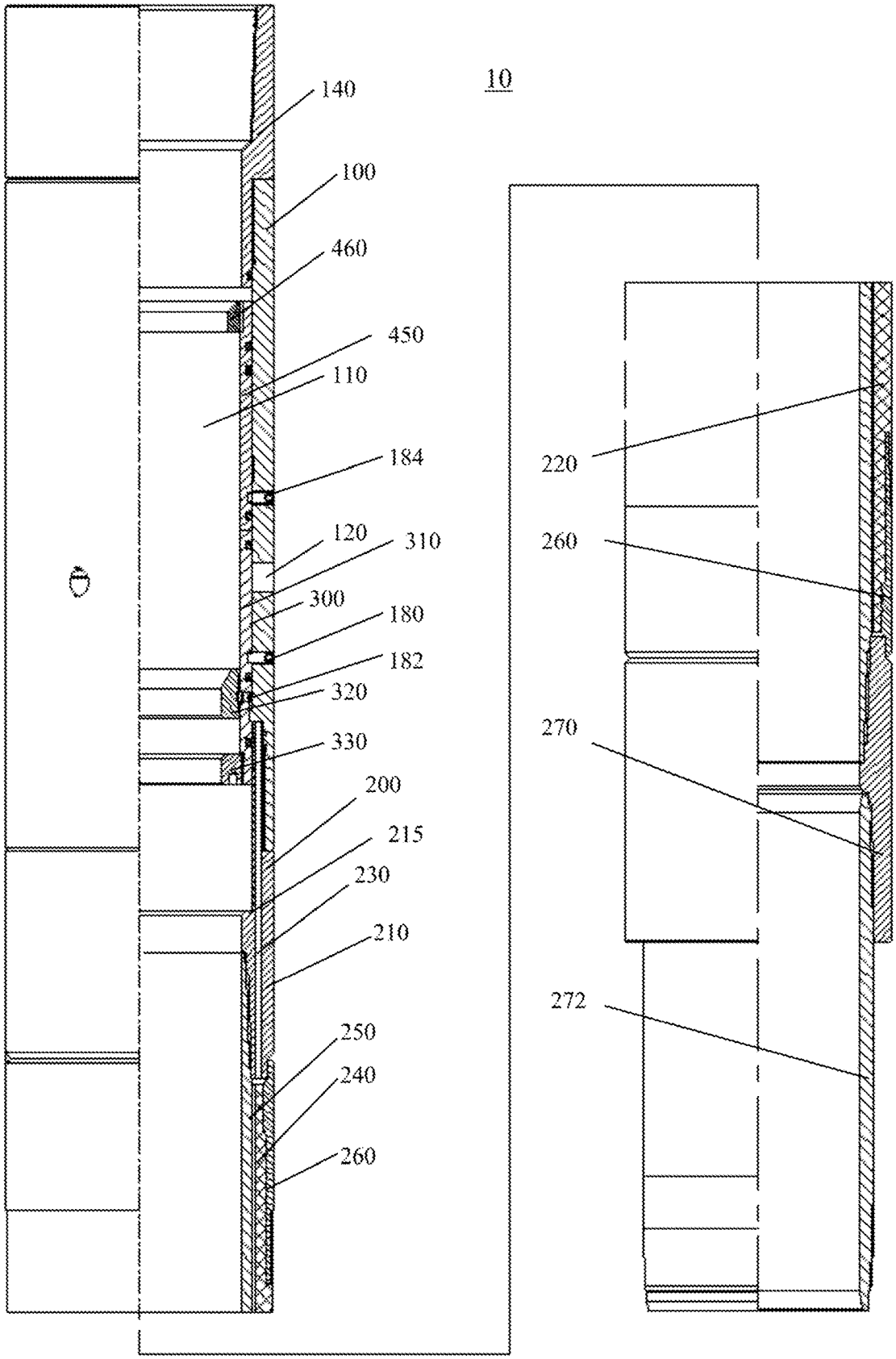
FIG. 1 shows the overall structure of a staged cementing device according to a specific embodiment of the present invention, wherein the device is in an initial state.

FIG. 1 schematically shows the structure of a staged cementing device according to the present invention. In this specific embodiment, the staged cementing device is a staged cementing device 10 with a multiple-expansible packer.

As shown in FIG. 1, the staged cementing device 10 includes a hollow cylindrical body 100. The body 100 includes an inner chamber 110 formed therein, a circulating opening 120 extending through a wall of the body, and a liquid inlet recess 130 (see FIG. 2), which is formed on an inner surface of the wall of the body and in communication with the inner chamber 110. An upper joint 140 is connected to an upstream end of the body 100, in order to connect with other components of a casing. The liquid inlet recess 130 is disposed downstream of the circulating opening 120, which is used for a secondary cementing procedure. The function of the circulating opening is well known in the art, and thus will not be described in detail here. The function of the liquid inlet recess 130 will be described in detail below.

Figure 2:
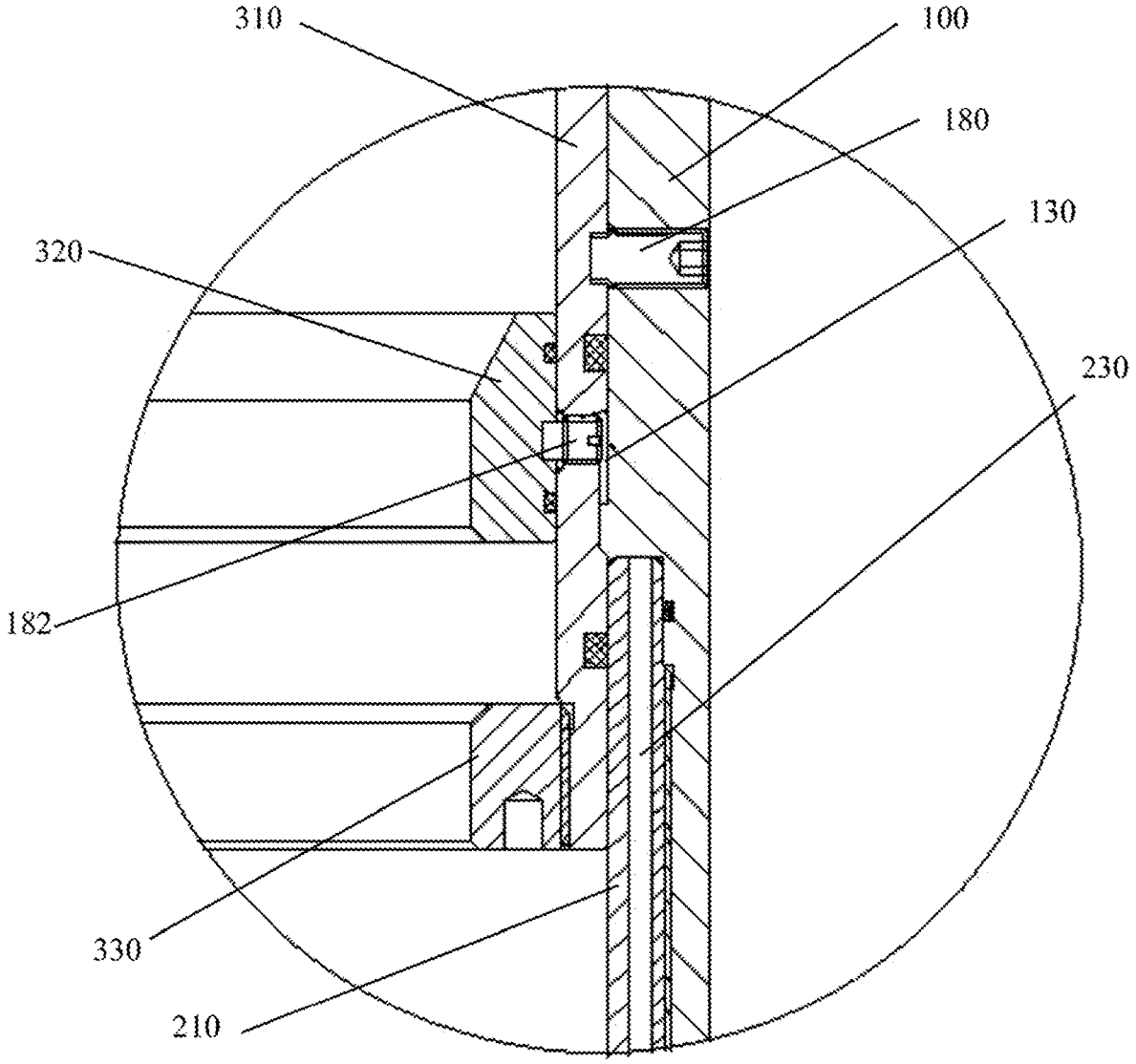
FIG. 2 is a partial enlarged view of the device as shown in FIG. 1, showing the positions of an opening seat and an opening sleeve.

According to the present invention, an opening assembly 300 is provided in the cylindrical body 100 of the staged cementing device 10, and includes an opening sleeve 310 arranged in the body 100 and an opening seat 320 arranged in the opening sleeve 310. In an initial state as shown in FIG. 1, the opening sleeve 310 is connected to the body 100 through a first shear pin 180, and covers the circulating opening 120. As shown in FIG. 2, the opening seat 320 is connected to the opening sleeve 310 through a second shear pin 182, and covers the liquid inlet recess 130. In the embodiment as shown in FIGS. 1 and 2, the first shear pin 180 is disposed downstream of the circulating opening 120, but upstream of the second shear pin 182. The shear stress of the first shear pin 180 is set to be greater than that of the second shear pin 182, that is, the second shear pin 182 will be sheared off prior to the first shear pin 180.

Figure 3:
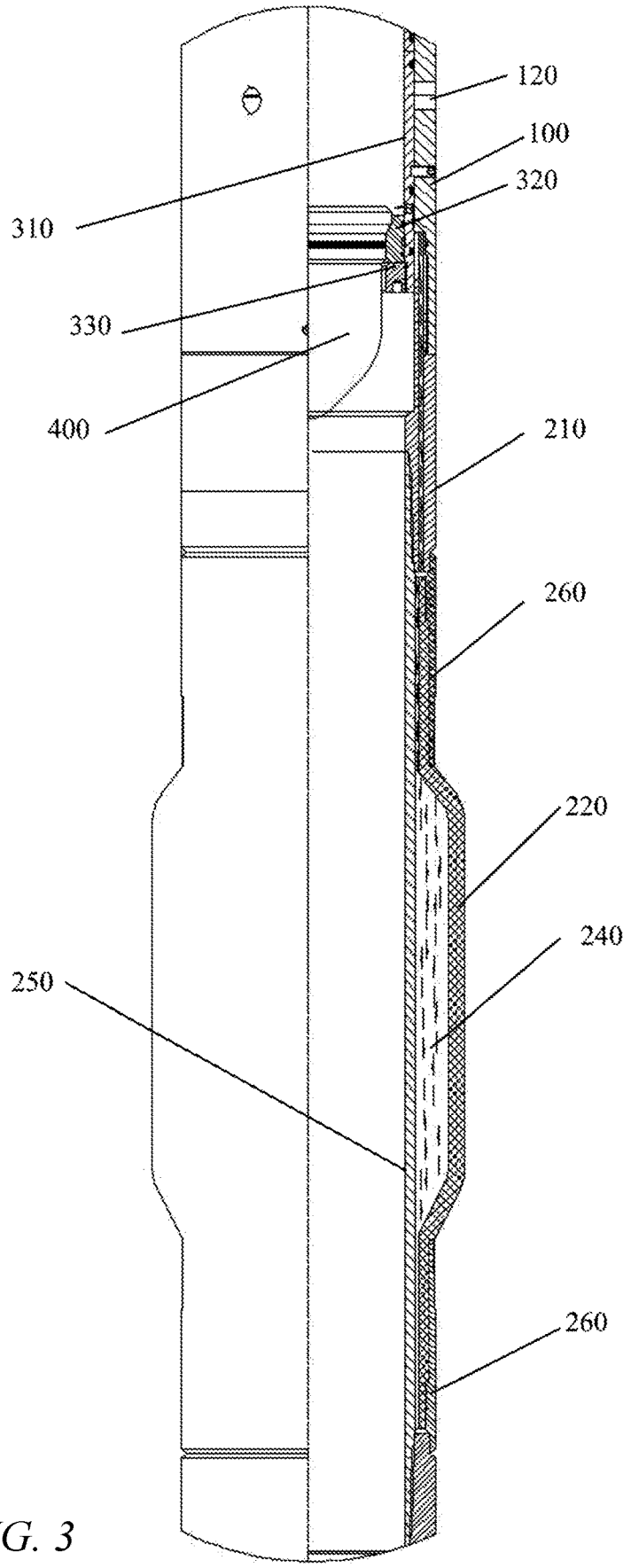
FIG. 3 shows the staged cementing device according to the present invention, wherein a packer rubber is in an expanded state but a circulating opening is still closed.

As used herein, the term "initial state" refers to a state prior to a primary cementing procedure. FIGS. 1 and 2 both show the staged cementing device 10 in the initial state. FIG. 3 shows a state after the primary cementing procedure but before the secondary cementing procedure.

In addition, according to an embodiment of the present invention, the opening assembly 300 further includes a receiving seat 330. As shown more clearly in FIG. 2, the receiving seat 330 is secured within the opening sleeve 310 through, for example, threads, and preferably located at a downstream end of the opening sleeve 310. The receiving seat 330 is used to receive the opening seat 320 moving downward, thus defining the distance of the downward movement of the opening seat 320. This downward movement of the opening seat 320 will be described in detail below.

As shown in FIG. 1, according to the present invention, the staged cementing device 100 further includes a packer 200 disposed downstream of the cylindrical body 100. The packer 200 includes a packing valve body 210, which is fixedly connected to the downstream end of the body 100 by, e.g., threaded engagement. The packing valve body 210 is of, for example, a cylindrical structure, with a step 215 formed on an inner wall thereof. The packer 200 further includes a base pipe 250, which is, for example, fixedly connected to a downstream end of the packing valve body 210, and a packer rubber 220 arranged around the base pipe 250. In the illustrated embodiment, an upstream end of the base pipe 250 extends into an inner chamber of the packing valve body 210, and is connected with the downstream end of the packing valve body 210 through threads. A lower joint 270 is provided at a downstream end of the packer rubber 220. The lower joint 270, together with a short casing 272 fixed thereto, is used to connect subsequent tools.

As shown in FIG. 2, the packing valve body 210 includes an axially extending flow channel 230 formed therein, which is in communication with the liquid inlet recess 130 in the body 100. The flow channel 230 extends axially throughout the packing valve body 210. In addition, as shown in FIG. 1, the packer rubber 230 includes a liquid reservoir 240 in communication with the flow channel 230. The liquid reservoir 240 can similarly extend axially within the packer rubber 220. In an alternative embodiment, the liquid reservoir 240 may be formed by a gap between the base pipe 250 and the packer rubber 220. Moreover, two supporting sleeves 260 which are separated from each other are provided around the packer rubber 230. A first supporting sleeve 260 located upstream is connected with the packing valve body 210, while a second supporting sleeve 260 located downstream is connected with the lower joint 270. The two supporting sleeves 260 can be used to limit an axial area where the packer rubber 220 expands. That is, a portion of the packer rubber 220 between said two supporting sleeves 260 can expand outward.

An accelerant is filled in the liquid reservoir 240 of the packer rubber 220. The accelerant is a kind of liquid that can be uniformly mixed with a swelling fluid (for example, a part of a displacing fluid, preferably liquid epoxy resin) and then cured, so as to realize a secondary expansion of the packer rubber 220, which will be described in detail below. One skilled in the art can readily select the type of the accelerant according to the specific swelling fluid used. In addition, by adding necessary components in the accelerant, the reaction time for the accelerant and the swelling fluid can be controlled. That is, the accelerant can be reacted with the swelling fluid at a predetermined time, so as to realize the secondary expansion of the packer rubber at the predetermined time.

According to an embodiment of the present invention, the packer rubber 220 is made from hydrocarbon-expansible rubber, which can be expanded continuously in the presence of hydrocarbons, so that the packer rubber 220 can meet the performance requirements on the primary and secondary expansions at the same time.

Figure 5:
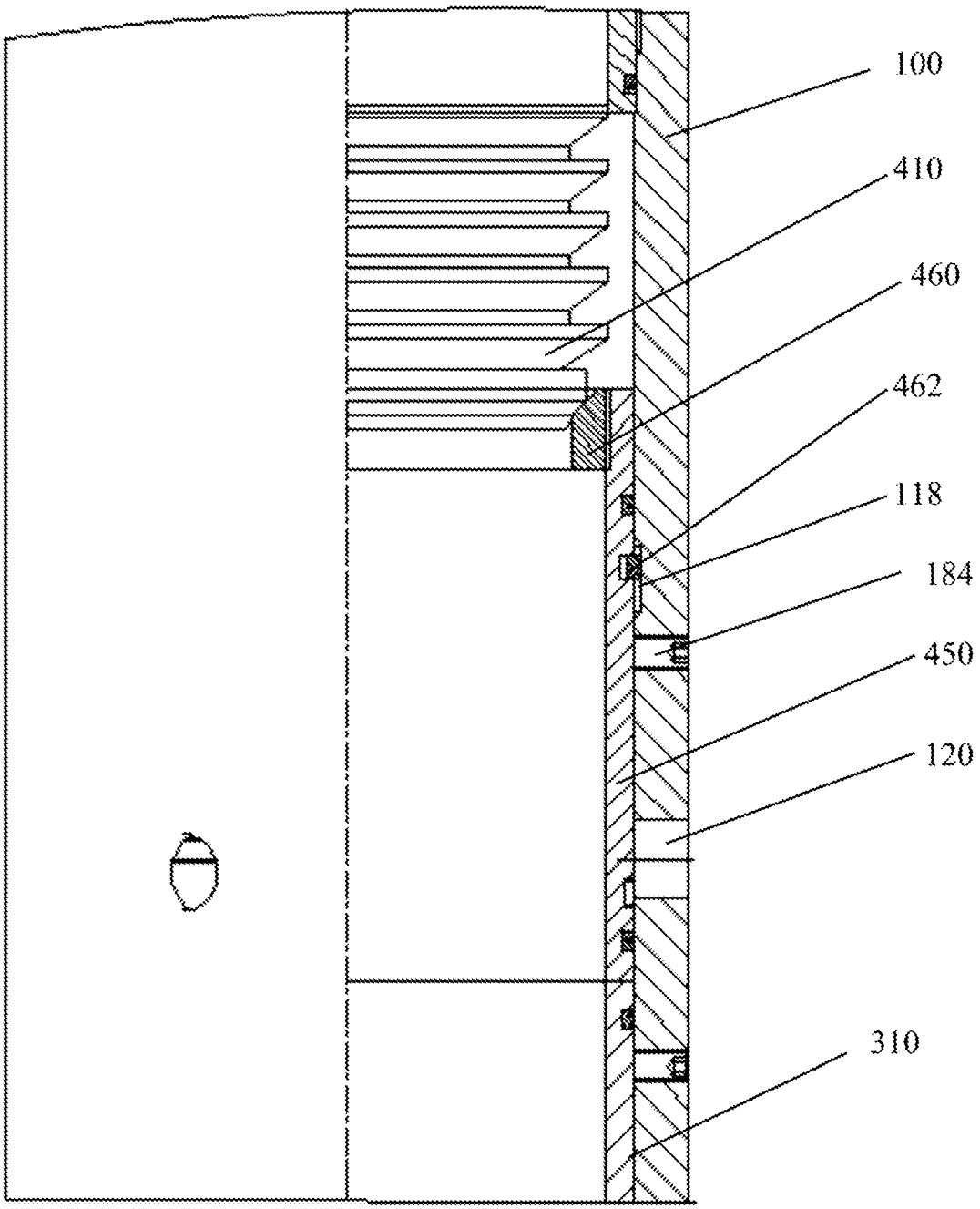
FIG. 5 is a partial schematic view of the staged cementing device according to the present invention, showing a state in which the circulating opening is closed again.

In addition, as shown in FIG. 1, in the body 100, a closing sleeve 450 is further provided upstream of the opening sleeve 310. In the initial state, the closing sleeve 450 directly abuts with the opening sleeve 310, and is connected with the body 100 through a third shear pin 184. A closing seat 460 is provided at an upper end of the closing sleeve 450. In a preferred embodiment, as shown in FIG. 5, a snap ring 462 is provided on an outer wall of the closing sleeve 450, and a snap-ring groove 118 that can be in engagement with the snap ring 462 is provided in the inner wall of the body 100. The specific functions of the closing sleeve 450 and the closing seat 460 as well as the snap ring 462 and the snap-ring groove 118 will be described below.

As shown in FIGS. 1 and 2, in the initial state, the opening sleeve 310 of the opening assembly 300 is connected with the body 100 through the first shear pin 180, and thus covers the circulating opening 120. At the same time, the opening seat 320 of the opening assembly 300 is connected with the opening sleeve 310 through the second shear pin 182, and thus covers the liquid inlet recess 130. At this time, the inner chamber 110 of the body 100 is not in communication with the flow channel 230 in the packing valve body 210 of the packer 200. In this way, the displacing fluid entering the inner chamber 110 of the body 100 during the primary cementing and mud replacing procedure cannot enter the flow channel 230 in the packing valve body 210 of the packer 200, so that the displacing fluid is physically isolated from the accelerant in the liquid reservoir 240.

Figure 6:
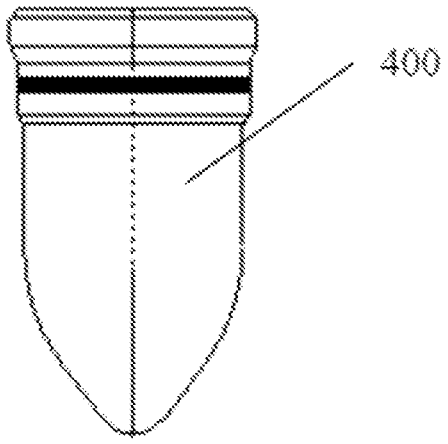
FIG. 6 shows an opening tool according to one embodiment of the present invention.

As shown in FIG. 3, when an opening tool 400 as shown in FIG. 6 is put into the staged cementing device 100 according to the present invention, the opening tool 400 will be in engagement with the opening seat 320 as moves downward, thereby blocking up the inner chamber 110 of the body 100.

The second shear pin 182 will be sheared off by a pressure build-up in the body 100, which is referred to herein as "primary pressure build-up". In this case, the opening tool 400 will move downward together with the opening seat 320, until the opening seat 320 is received on the receiving seat 330. At this time, due to the downward movement of the opening seat 320, the liquid inlet recess 130 will be no longer blocked up by the opening seat 320, and thus in communication with the inner chamber 110. In this way, the displacing fluid in the inner chamber 110 can enter the liquid reservoir 240 in the packer rubber 220 through the liquid inlet recess 130 and the flow channel 230 in the packing valve body 210. Under the action of the hydraulic pressure of the swelling fluid, the packer rubber 220 generates expansion (i.e., the primary expansion) to fit with the borehole wall, thus isolating the annulus into an upper part and a lower part.

Figure 4:
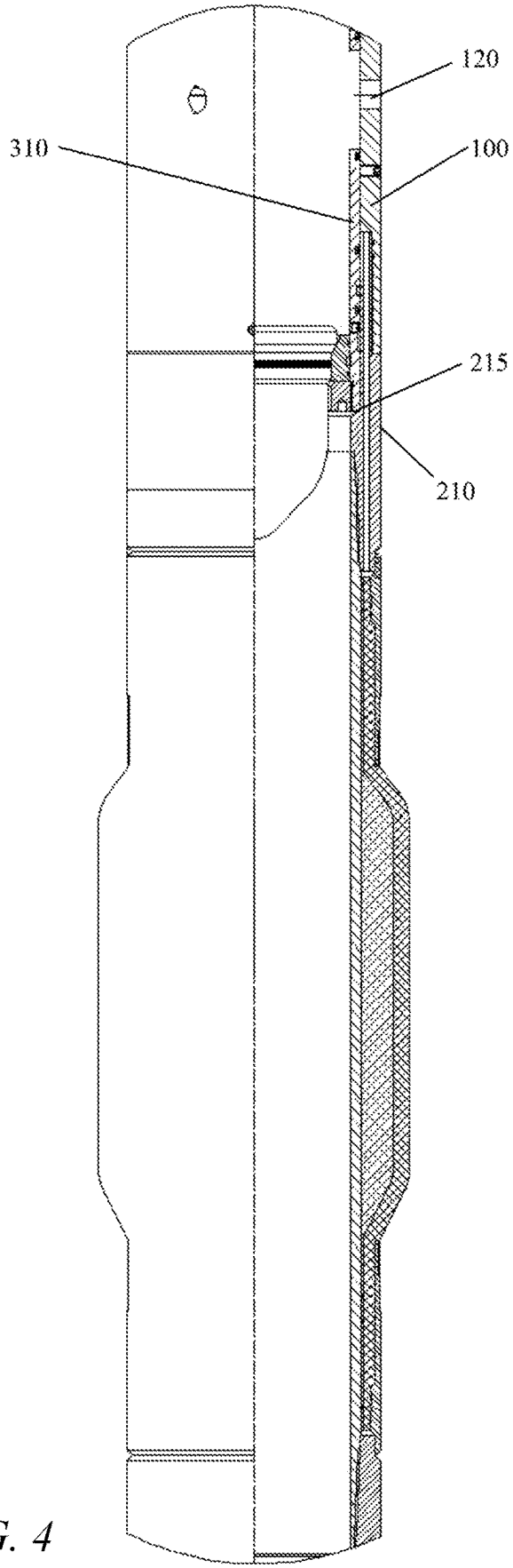
FIG. 4 shows the staged cementing device according to the present invention, wherein the packer rubber is in the expanded state and the circulating opening is opened.

After that, a further pressure build-up, which is referred to herein as "secondary pressure build-up", is performed in the body 100, so that the first shear pin 180 is sheared off. In this case, the opening sleeve 310 is able to move downward relative to the body 100, until it abuts on the step 215 of the packing valve body 210, as shown in FIG. 4. At this time, the circulating opening 120 is exposed, while the liquid inlet recess 130 is blocked up again by the opening sleeve 310 moving downward, thereby cutting off the communication between the liquid inlet recess 130 and the inner chamber 110 again. In this case, the secondary cementing procedure can be performed.

Figure 7:
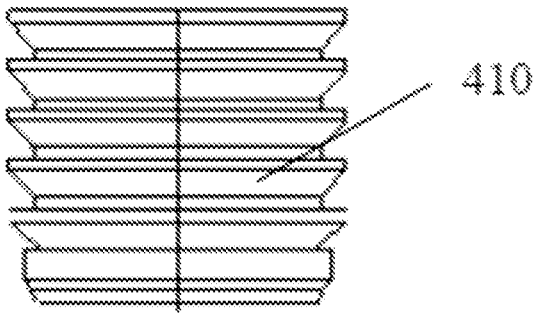
FIG. 7 shows a closing tool according to one embodiment of the present invention.

During the secondary cementing procedure, the swelling fluid will be uniformly mixed with the accelerant, and solidified with the packer rubber 220 as a whole. In this case, the secondary expansion of the packer rubber 220 can be achieved. At this time, the closing tool 410 as shown in FIG. 7 can be put down and a mud replacement can be performed. As shown in FIG. 5, when the closing tool 410 falls down onto the closing seat 460 and seals thereon, an upper part of the closing seat 460 forms a closed cavity. At this point, a further pressure build-up, which is referred to herein as "tertiary pressure build-up", is performed in the body 100 to shear off the third shear pin 184. In this way, the closing sleeve 450 descends relative to the body 110 and closes the circulating opening 120 again. In this position, the snap ring 462 located on the outer wall of the closing sleeve 450 will enter the snap-ring groove 118 formed in the inner wall of the body 100. Through the engagement of the snap spring 462 and the snap-spring groove 118, the backward movement of the closing sleeve 450 can be prevented, thereby realizing permanent closure of the circulating opening 120.

After the completion of the secondary cementing procedure, if hydrocarbon medium, such as oil and gas, enters the annulus during the production, the packer rubber 220 made of hydrocarbon-expandable rubber will absorb the hydrocarbon medium from the well, and thus generate a further expansion (i.e., tertiary expansion). The tertiary expansion can fill tiny gaps, prevent oil, gas and water from flowing upward, and avoid the pressure problem in the annulus.

As described above, according to the staged cementing device 100 of the present invention, the packer 200 will not be affected by the pressure in the pipe. The liquid injection channel cannot be opened without the opening tool 400, thus avoiding accidental opening operation caused by the pressure in the pipe. In addition, after the liquid injection channel is opened, the displacing fluid enters the liquid reservoir 240 of the packer rubber 220, so that the primary expansion of the packer can be realized through the hydraulic pressure of the swelling liquid, so as to block up the annulus. In this way, after the circulating opening 120 is opened, the liquid column pressure will be reduced, thereby reducing the leakage of the primary cement mud, preventing the leakage of the secondary cement, and thus improving the quality of the well cementation. Moreover, the accelerant in the packer 200 will be chemically reacted with the displacing fluid to be cured in a short time, thus forming into one piece with the packer rubber 220. In this way, after curing, the packer rubber 220 will not shrink but expand slightly in terms of volume, thereby realizing the secondary expansion of the packer 200. Therefore, it is possible to avoid the aging and damage of the packer rubber 220, which may cause the liquid to flow out and eventually lead to the failure of the packer 200. Further, the packer rubber 220 of the packer 200 is made of hydrocarbon-expansible rubber, which can, on the basis of previous expansions, generate a further expansion (i.e., tertiary expansion) under hydrocarbon medium, such as gas or oil, in the reservoir. This tertiary expansion can fill tiny gaps, thus further improving the long-term sealing ability of the packer.

Although the present invention has been described with reference to the preferred embodiments, various modifications may be made and equivalents may be substituted for components thereof without departing from the scope of the present invention. In particular, under the condition that there is no structural conflict, each technical feature mentioned in each embodiment can be combined in any manner. The present invention is not limited to the specific embodiments disclosed herein, but includes all technical solutions falling within the scope of the claims.

The invention claimed is:

1. A staged cementing device (10), comprising:

a body (100) having an inner chamber (110), a circulating opening (120) extending through a wall of the body, and a liquid inlet recess (130) open to the inner chamber and formed on the wall of the body;

an opening assembly (300) arranged in the body, the opening assembly comprising an opening sleeve (310) and an opening seat (320) located in the opening sleeve (310), wherein in an initial state, the opening sleeve (310) is connected with the body (100) through a first shear pin (180) and covers the circulating opening (120), and the opening seat (320) is connected with the opening sleeve (310) through a second shear pin (182) and covers the liquid inlet recess (130); and a packer (200), wherein the packer (200) comprises a packing valve body (210) connected with a downstream end of the body, and a packer rubber (220) arranged downstream of the packing valve body, the packing valve body (19) comprises a flow channel (230) in communication with the liquid inlet recess (130), and the packer rubber (220) comprises a liquid reservoir (240) in communication with the flow channel (230), wherein the liquid reservoir (240) contains an accelerant for a swelling fluid, wherein the second shear pin (182) is configured to be sheared off in response to a primary pressure build-up in the body (100), causing the opening seat (320) to move downward to open the liquid inlet recess (130) so that the swelling fluid in the inner chamber (110) of the body (100) enters the liquid reservoir (240) through the liquid inlet recess (130) and the flow channel (230) and reacts with the accelerant in the liquid reservoir (240).

2. The staged cementing device according to claim 1, wherein the swelling liquid is a part of displacing fluid.

3. The staged cementing device according to claim 1, wherein the primary pressure build-up is achieved by putting down an opening tool (400) engageable with the opening seat (320).

4. The staged cementing device according to claim 3, wherein a receiving seat (330) is further provided at a downstream end of the opening sleeve (310) for restricting a distance of downstream movement of the opening seat (320).

5. The staged cementing device according to claim 1, wherein the liquid inlet recess (130) is configured as a groove formed in an inner wall of the body (100), wherein the flow channel (230) is formed in a wall of the packing valve body (210) and extends axially throughout the packing valve body (210).

6. The staged cementing device according to claim 1, wherein the packer (200) further comprises a base pipe (250) fixedly connected with the packing valve body (210), wherein the base pipe (250) is located radially inside the packer rubber (220), and the liquid reservoir (240) is formed by a gap between the base pipe and the packer rubber.

7. The staged cementing device according to claim 6, wherein two supporting sleeves (260) separated from each other are provided on an outer surface of the packer rubber (230), thereby defining an axial area where the packer rubber (230) expands.

8. The staged cementing device according to claim 1, wherein the first shear pin (180) is configured to be sheared off in response to a secondary pressure build-up in the body (100), which causes the opening sleeve (310) to move downstream, thereby opening the circulating opening (120) and closing the liquid inlet recess (130).

9. The staged cementing device according to claim 1, wherein a closing sleeve (450) is provided upstream of the opening sleeve (310), and connected with the body (100) through a third shear pin (184), wherein the third shear pin (184) is configured to be sheared off in response to a tertiary pressure build-up in the body (100) causing the closing sleeve (450) to move downstream to close the circulating opening (120).

10. The staged cementing device according to claim 9, wherein a closing seat (460) is provided in the closing sleeve (450), and the tertiary pressure build-up is achieved through putting down a closing tool (410) engageable with the closing seat (460).

11. The staged cementing device according to claim 9, wherein an elastic member (462) is provided on an outer wall of the closing sleeve (450), and an elastic-member receiving groove (118) is provided in the inner wall of the body for receiving the elastic member (462) and maintaining a position of the closing sleeve (450) after the closing sleeve (450) closes the circulating opening (120).

12. The staged cementing device according to claim 1, wherein the packer rubber is made of hydrocarbon-expansible rubber.

13. A staged cementing method with the staged cementing device according to claim 11, comprising steps of:

putting down an opening tool (400) in the staged cementing device to engage with the opening seat (320), and shearing off the second shear pin (182) through the primary pressure build-up, so that the opening seat (320) moves downstream to open the said liquid inlet (130);

causing the swelling liquid to enter the liquid reservoir (240) through the inner chamber (110) of the body (100), the liquid inlet recess (130) and the flow channel (230), thereby causing the packer rubber (220) to expand;

shearing off the first shear pin (180) through the secondary pressure build-up so that the opening sleeve (310) moves downstream to open the circulating opening (120), and at the same time communication between the liquid inlet recess (130) and the flow channel (230) is cut off; and putting down the closing tool (410) to be in engagement with the closing seat (460), and shearing off the third shear pin (184) through the tertiary pressure build-up, so that the closing sleeve (450) moves downstream to close the circulating opening (120).

14. The staged cementing method according to claim 13, wherein the swelling fluid reacts with the accelerant in the liquid reservoir (240).

* * * * *